United States Patent [19]

Furr

[11] 4,046,378

[45] Sept. 6, 1977

[54] TABLE SOCCER PLAYING FIGURE

[75] Inventor: Robert L. Furr, Dallas, Tex.

[73] Assignee: Robert I. Hayes, Jr., Dallas, Tex. ; a part interest

[21] Appl. No.: 675,786

[22] Filed: Apr. 12, 1976

[51] Int. Cl.[2] ..... A63F 7/10

[52] U.S. Cl. ..... 273/85 D; 273/129 HB

[58] Field of Search ..... 273/85 C, 85 D, 85 F, 273/129 R, 129 C, 129 HB, 129 HA

[56] References Cited

U.S. PATENT DOCUMENTS

| | | | |
|---|---|---|---|
| 3,920,244 | 11/1975 | Kaiser | 273/85 D |
| 3,926,432 | 12/1975 | Furr et al. | 273/85 D |

FOREIGN PATENT DOCUMENTS

| | | | |
|---|---|---|---|
| 991,037 | 6/1951 | France | 273/85 C |
| 532,808 | 9/1955 | Italy | 273/85 C |
| 6,515,128 | 5/1967 | Netherlands | 273/85 D |

*Primary Examiner*—Richard C. Pinkham
*Assistant Examiner*—Harry G. Strappello
*Attorney, Agent, or Firm*—Crisman & Moore

[57] ABSTRACT

An improved playing figure for use in a table soccer or football game structure. The figure is rigidly mounted to an actuating rod which is, in turn, journaled in bearings near opposing ends for both rotational and axial movement above the playing surface of the game structure. The playing figure includes a foot portion depending above the playing surface and having smooth, flat vertically extending side portions and pebbled inwardly and downwardly tapering front and rear surfaces. The front surface of the playing figure foot is pebbled over its entire surface and lies in a plane angled rearwardly with respect to the longitudinal axis of the figure. The rear foot surface is also pebbled over most of its entire surface and lies in a plane angled forwardly with respect to the longitudinal axis of the figure except for an unpebbled control corner extending horizontally along the lower rear edge of the foot in a plane parallel to both the vertical and horizontal axes of the figure. In general, the control corner increases the firmness with which a playing ball may be trapped between the playing foot and the playing surface. The control corner of the improved playing figure foot enables a player to catch, pass and otherwise manipulate a ball upon the playing surface with substantially greater dexterity than with the foot configuration of prior art playing figures.

10 Claims, 6 Drawing Figures

TABLE SOCCER PLAYING FIGURE

BACKGROUND OF THE INVENTION

The invention relates to playing figures for use in table soccer or fussball game structures and, more particularly, to a playing figure having an improved foot portion for more dextrous manipulation of a playing ball.

The invention is used in a fussball (also known as table soccer) game table of the type shown and claimed in U.S. Pat. No. 3,926,432 issued Dec. 16, 1975 to Robert L. Furr and Robert I. Hayes, Jr.. Fussball game tables typically include a rectangular, box-like playing area supported on a plurality of legs at about waist height of a player. A plurality of axially slidable and rotatable actuating rods are mounted extending transversely of the playing area. The actuating rods mount a plurality of playing figures which are arranged above the playing surface of the table in a preselected formation. A ball is placed on the playing surface and propelled by sharply rotating the actuating rods so that a foot of a playing figure strikes the ball and propels it along the playing surface toward one of the two goals located in opposite end walls.

In playing the game of table soccer, skilled players repeatedly manipulate the playing ball back and forth between adjacent ones of their playing figures to set up a clear path between the ball and their opponent's goal opening. Such manipulation includes passing the ball from one playing figure to another. A pass is effected through propelling the ball with one figure by striking it with the foot portion thereof and catching it with the foot portion of a different figure. Another manner often used by players is that of manipulating a ball transversely with the rear foot portion of a figure and then suddenly circling the ball and shooting with the front of the foot portion. A ball passed from one figure to another is best caught with a receiving figure by first rotating the associated actuating rod to raise the foot portion to trap the ball between the foot portion and the playing surface of the table. The pebbled front and rear surfaces of the foot portion of prior art playing figures greatly facilitate gripping a ball between the foot and the playing field surface. However, in the event the ball is inadvertently gripped too tightly by the playing figure foot portion the angled surface thereof, despite the presence of pebbles, may cause the ball to "squirt" from the grasp of the figure. The present invention reduces the likelihood of a player losing the ball to his opponent by allowing it to slip from his playing figure's grasp while receiving a pass or while otherwise manipulating the ball between the foot portion and the playing surface.

SUMMARY OF THE INVENTION

The invention relates to improvements in table soccer games, commonly called by their popular name fussball (such term being used periodically throughout the disclosure), and, more particularly, to a playing figure therefor which improves the ball handling of the game to increase the precision and sophistication with which the game is capable of being played.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

As disclosed more fully in U.S. Pat. No. 3,926,432 issued Dec. 16, 1975 to Robert L. Furr and Robert I. Hayes, Jr., a fussball game table includes a playing surface 10 shown in cross-section in FIG. 1, vertically extending end and sidewalls and a plurality of actuating rods 13, shown only in cross-section in FIG. 1, rotatably mounted and axially slidable in opposite sidewalls. The actuating rods 13 are rotatably and slidably supported in a plurality of pairs of bearings (not shown) which are spaced along and in axial alignment with clearance apertures passing through the opposed longitudinal sidewalls. Each actuating rod 13 slidably mounts one or more game figures 18. Soft, shock absorbing, cylindrical rubber bushings (not shown) are rigidly mounted to each of the actuating rods 13 and are located outside the outermost game figures 18 on each rod 13. The rubber bushings serve as bumpers to prevent the rod mounted game figures 18 from striking too hard against the inner sides of the wall, even during vigorous playing as the actuating rods 13 are quickly shifted laterally to move the figures carried thereby relative to the playing surface 10.

Figure 1:
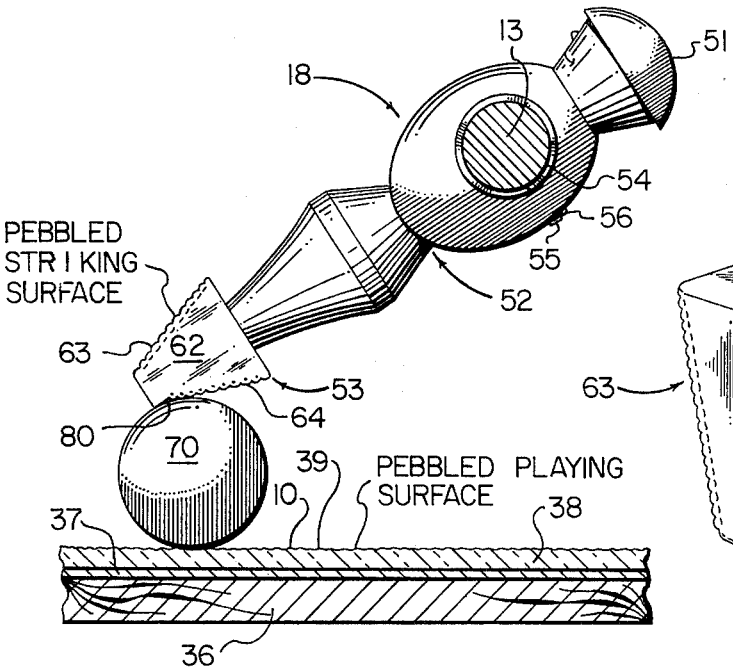
FIG. 1 is a side view of a fussball playing figure constructed in accordance with the invention and illustrating one manner in which the improved foot portion enhances the ball handling ability of the figure.

Still referring to FIG. 1, there is shown a typical cut-away cross-section view of the bottom of the table with sides and ends removed and cut-away diagrammatic top view of the upper surface of the playing area 10. While the particular pebbled configuration of the upper playing surface described herein is certainly unnecessary to practice the improved foot portion of the present invention, it is disclosed and claimed herein with the improved foot portion of the present invention eventhough it has been previously generally disclosed and claimed in a fussball table in U.S. Pat. No. 3,926,432. In FIG. 1, it can be seen how a wooden underlayer 36 supports a paper sheet 37 having a soccer field configuration printed thereon. The sheet 37 is covered by a layer of glass 38 having a pebbled upper surface 39. The glass 38 is preferably of a type of figured, rolled glass such as that sold under the brand name of "Industrex" by ASG Industries of Kingsport, Tenn. A similar suitable figured rolled glass is that sold under the brand name of "Factrolite" by C. E. Glass Company of St. Louis, Mo. The upper surface of the glass is comprised of a plurality of rounded pebbles arranged on the surface of the glass in a selected pattern. The pattern is preferably formed so that there are a number of linear paths formed in the valleys between adjacent pebbles 39. The inclusion of a pebbled glass playing surface results in a fussball table with substantially improved playing characteristics. For example, during relatively slow movement of the ball between different ones and adjacent ones of the playing figures, the pebbles aid in providing a secure grip on the ball between the surface of the playing figure foot portion and the playing surface 10.

Referring to the playing figure 18 of FIG. 1, constructed in accordance with the present invention, there is included a head portion 51, a body portion 52, and a foot portion 53. The body portion is perforated by a transverse opening 54 for receiving the actuating rod 13, therethrough. A lateral opening, transverse to the opening 54, is formed in the body portion to receive a bolt 55 which also passes through a pair of aligned apertures in the actuating rod 13 and is secured by a nut 56 held in position by a hexagonal socket (not shown) formed in the rear of the body portion. The bolt 55 passing through the aligned lateral openings rigidly secures the playing figure 18 to the actuating rod 13 passing through the opening 54.

Figure 5:
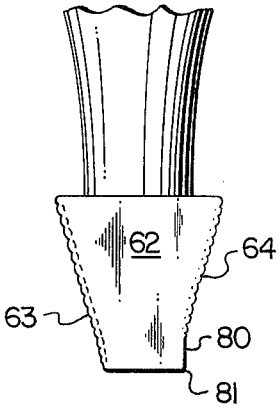
FIG. 5 is a cut-away left side view of the playing figure foot portion of FIG. 4.
Figure 6:
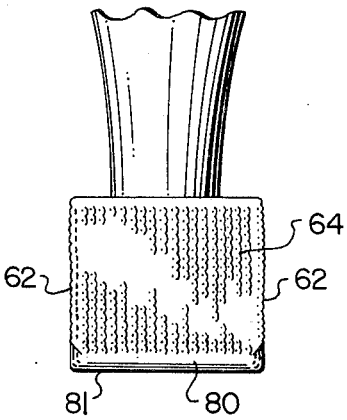
FIG. 6 is a cut-away rear view of the playing figure foot portion shown in FIG. 4.

The foot portion 53 of the playing figure 18 is of large significance in that it is the means by which the ball is manipulated and propelled toward an opponent's goal opening. The side surfaces 62 of the foot portion 53 are preferably smooth, flat and lie in a generally vertical plane to facilitate lateral passing of the ball from one playing figure to another figure on the same rod by merely tapping it. The front and rear surfaces 63 and 64, respectively, of the foot portion 53 are generally flat and pebbled for, among other things, increased grip. The angle of the pebbled foot surfaces 63 and 64 with the longitudinal axis of the playing figure 18, best shown in FIGS. 1, 5 and 2 (Prior Art), is selected to permit the playing figure to propel the ball at very high velocity without "lofting" the ball or allowing it to leave the playing surface.

Figure 2:
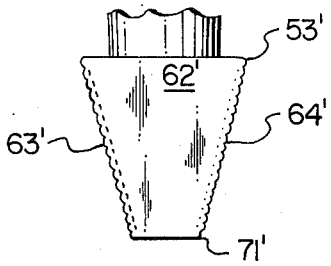
FIG. 2 (PRIOR ART)
FIG. 2 is a cut-away side view of a prior art playing foot portion.
Figure 4:
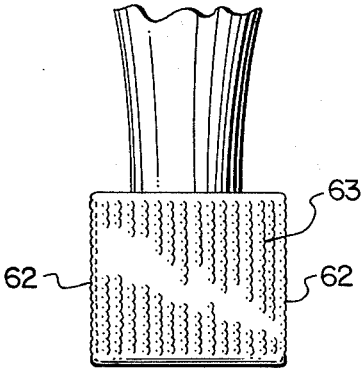
FIG. 4 is a cut-away front view of a playing figure foot portion constructed in accordance with the invention.

Referring to the prior art foot portion 53', a side view of which is shown in FIG. 2, it will be noted that if the prior art foot 53' were substituted for the foot portion of the invention 53 in FIG. 1, it would be considerably more difficult to grip the ball between the rear surface of the foot portion and the playing surface. That is, if the ball 70 were to be gripped by a prior art foot 53' (FIG. 2) only the narrow edge 71' would be in contact with the ball. Applying too much pressure to the top of the ball 70 with the edge 71' while moving the ball transversely with a playing figure, i.e., parallel to the actuating rod 13, frequently results in the ball slipping and "squirting" forwardly or rearwardly from the grasp of the figure.

Figure 3:
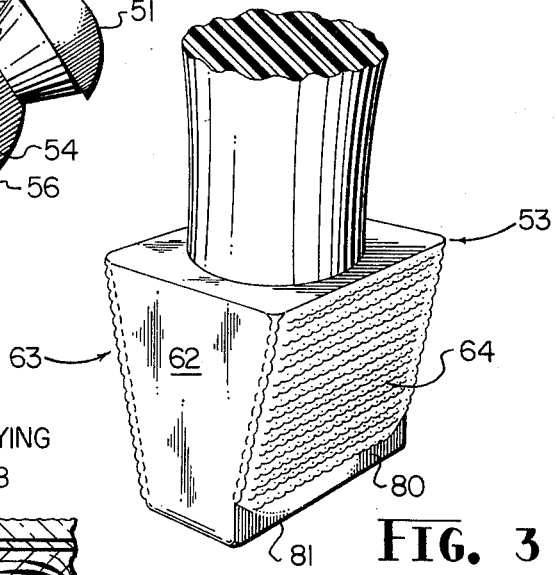
FIG. 3 is a cut-away perspective view of a playing figure foot portion having a control corner constructed in accordance with the invention.

These disadvantages, among others, of the prior art are overcome by the foot portion of the playing figure of the present invention. Referring to FIG. 3, the foot portion 53 of the present invention includes a control corner 80 on the lower rear portion of foot which is not in the same plane as the remainder of the rear of the foot portion 64 but, rather, lies in a plane substantially parallel with both the longitudinal and the transverse axes of the playing figure. The control corner 80 comprising a strip running along the bottom edge of the foot striking surface (either front or rear 63 or 64) effectively creates a channel along which the ball 70 can be constrained or moved with substantially less likelihood of losing one's grip on the ball. Further, the corner 80 provides an edge 81 forward of the ball 70 so that if the ball slips, it is more likely to move rearwardly (in a direction toward the actuating rod 13 in FIG. 1) and be more readily subject to recapture by the figure than if it slips forwardly. Further, the use of a pebbled playing surface, as discussed above, assists the control corner in maintaining a reliable grip on the ball.

While the control corner has been shown on the bottom rear edge of the foot portion, it could possibly be located along the bottom front edge of the foot portion although this might hamper the accuracy with which the playing figure could shoot the ball toward an opponent's goal opening. In general, however, most players manipulate and catch a ball with the rear of the playing figure foot portion. Additionally, although the control corner 80 has been shown in FIGS. 1, 3, 5 and 6 as unpebbled, it is more significant that the corner 80 lies in a plane generally parallel to the longitudinal axis of the figure and forms an angle with the upper part of the foot portion 64 of less than one hundred eighty degrees (180°) than it be unpebbled. Accordingly, the control corner 80 might be pebbled in certain embodiments.

As can be seen from the above description, the playing figure of the present invention includes features which provide a distinct advantage over prior art figures in ball handling and control during fussball play.

Having described the invention in connection with certain specific embodiments thereof, it is to be understood that further modifications may now suggest themselves to those skilled in the art and it is intended to cover such modifications as fall within the scope of the appended claims.

What is claimed is:

1. A fussball game table of the type having a playing field portion surrounded by raised opposite sidewalls and raised opposite end walls, said end walls each having a goal opening therein;

a plurality of actuating rods extending through said opposite sidewalls spaced transversely of one another and above said playing field portion;

a plurality of game figures mounted to said actuating rods and depending therefrom adjacent said playing field portion and each including a foot portion adapted to contact a ball thereon, said foot portions each including generally planar front and rear surfaces having a plurality of pebbles formed thereon for increased traction on the ball, said front and rear foot surfaces being angled toward an apex located beyond the bottom of the foot, a flat bottom lying normal to the longitudinal axis of the figure and planar side surfaces lying in a generally vertical plane, wherein the improvement comprises:

a control corner lying along the lower edge of the rear foot portion in a plane forming an angle with that of said rear foot surface.

2. An improved foot portion for a fussball game table playing figure as set forth in claim 1 wherein said control corner surface is unpebbled.

3. An improved foot portion for a fussball game table playing figure as set forth in claim 2 wherein the surface of said control corner lies in a plane generally parallel to the longitudinal and transverse axes of said figure.

4. A fussball game table having an improved playing figure foot portion as set forth in claim 1 wherein said playing field portion comprises a solid layer of material covering said playing field portion, said layer of material having an upper playing surface formed with a multiplicity of raised pebbles arranged in a fixed selected regular pattern throughout the entire playing field to cooperate with said control corner to improve the dexterity with which a ball can be manipulated by said improved foot portion.

5. An improved playing figure as set forth in claim 4 wherein the front and rear foot portions are pebbled except for said control corner surface which is unpebbled.

6. An improved playing figure for a table soccer game structure of the type having a plurality of game figures mounted to rotationally and axially movable actuating rods and said playing figures each having a foot portion thereof depending from its associated rod adjacent a playing field portion and adapted to contact a ball thereon, each of said playing figure foot portions including flat side surfaces lying in a generally vertical plane and generally flat front and rear surfaces lying in different planes positioned at an angle with respect to the longitudinal axis of the figure with the thickness of said foot portion being less at the bottom thereof than at the top, wherein said improvement comprises:

a control corner positioned along a bottom edge of a foot portion and lying in a plane generally parallel to the longitudinal and transverse axes of said playing figure to increase the degree of control said foot portion has over a playing ball while manipulating said ball.

7. An improved playing figure as set forth in claim 6 wherein said control corner is located along the lower rear edge of said foot portion.

8. An improved foot portion for a fussball playing figure of the type having generally planar front and rear surfaces which surfaces are both angled with respect to the longitudinal axis of the figure to form a narrower foot thickness near the toe rather than near the top thereof, side planar side surfaces lying in a plane parallel to the longitudinal axis of the figure and wherein said improvement comprises:

a control corner comprising a planar strip extending transversely across the lower edge of said angled rear foot surface, said strip lying in a plane more nearly parallel to the longitudinal and transverse axes of said figure than the plane of said angled rear foot surface to form a transversely extending channel along the line of intersection between said planar strip and said generally planar angled rear foot surface and enhance the ball handling dexterity of said improved foot.

9. An improved foot portion for a fussball playing figure as set forth in claim 8 wherein said angled front and rear foot portions have a plurality of pebbles formed thereon for increased traction on the ball.

10. An improved foot portion for a fussball playing figure as set forth in claim 9 wherein said planar strip is unpebbled.

* * * * *